US008322397B2

(12) United States Patent
Huang

(10) Patent No.: US 8,322,397 B2
(45) Date of Patent: Dec. 4, 2012

(54) MOLD FOR INJECTION MOLDING AND METHOD OF MANUFACTURING THEREOF

(75) Inventor: Wei-Da Huang, Taipei (TW)

(73) Assignee: Pegatron Corporation, Beitou District, Taipei (TW)

( * ) Notice: Subject to any disclaimer, the term of this patent is extended or adjusted under 35 U.S.C. 154(b) by 0 days.

(21) Appl. No.: 12/830,445

(22) Filed: Jul. 6, 2010

(65) Prior Publication Data

US 2011/0005701 A1 Jan. 13, 2011

(30) Foreign Application Priority Data

Jul. 7, 2009 (TW) ..... 98122956 A

(51) Int. Cl.
*B22C 9/06* (2006.01)
*B22D 17/00* (2006.01)

(52) U.S. Cl. ..... 164/19; 164/6; 164/46; 164/100; 164/303; 264/219

(58) Field of Classification Search ..... 164/46, 164/100, 107, 6, 19, 303; 264/219
See application file for complete search history.

(56) References Cited

U.S. PATENT DOCUMENTS

| | | | | |
|---|---|---|---|---|
| 3,638,299 | A * | 2/1972 | Garner et al. | 29/527.2 |
| 4,549,597 | A * | 10/1985 | Hamamura | 164/35 |
| 5,079,974 | A * | 1/1992 | Weiss et al. | 76/107.1 |
| 5,176,839 | A * | 1/1993 | Kim | 249/78 |
| 5,875,830 | A * | 3/1999 | Singer et al. | 164/19 |
| 6,309,587 | B1 * | 10/2001 | Gniatczyk et al. | 264/510 |
| 7,044,191 | B2 * | 5/2006 | Fischer et al. | 164/112 |

FOREIGN PATENT DOCUMENTS

| | | | |
|---|---|---|---|
| CN | 1597296 | A | 3/2005 |
| CN | 1706575 | A | 12/2005 |
| JP | 6442215 | | 2/1989 |
| JP | 2010201846 | A | 9/2010 |
| TW | 200826437 | | 6/2008 |

* cited by examiner

*Primary Examiner* — Devang R Patel
(74) *Attorney, Agent, or Firm* — Winston Hsu; Scott Margo

(57) ABSTRACT

This invention provides a mold for injection molding and a method of manufacturing thereof. The method of manufacturing a mold for injection molding includes the following steps. At least one temperature control element is provided. The temperature control element is covered with a first material. The first material is mechanically processed to form a mold body with a cavity. The mold for injection molding includes a mold body, a temperature control element, and a heat insulating layer.

10 Claims, 5 Drawing Sheets

MOLD FOR INJECTION MOLDING AND METHOD OF MANUFACTURING THEREOF

CROSS-REFERENCE TO RELATED APPLICATIONS

This Non-provisional application claims priority under 35 U.S.C. §119(a) on Patent Application No(s). 098122956 filed in Taiwan, Republic of China on Jul. 7, 2009, the entire contents of which are hereby incorporated by reference.

BACKGROUND OF THE INVENTION

1. Field of the Invention

This invention relates to a mold for injection molding and a method of manufacturing thereof and, more particularly, to a mold for injection molding including a temperature control element and a method of manufacturing thereof, 2. Description of the Related Art At present, casings of consuming products are mostly made by injection molding. During the injection molding process, molten molding materials are injected into a cavity of a mold. After the molding materials are cooled and hardened, the shape of the molding materials corresponds to the shape of the cavity to form the casings of the consuming products.

When the molding materials are injected into the cavity, the temperature of the molding materials is greater than the temperature of the mold. To prevent the molding materials from cooling too fast due to the lower temperature of the mold, a heating element such as a heat plate or a heat tube may be disposed in the mold to preheat the mold in the prior art. In addition, after the molding materials are totally injected into the cavity, the mold needs to be cooled to harden the molding materials in the cavity. In the prior art, a cooling element such as a cool tube may be disposed in the mold to cool the mold.

However, in the prior art, the heating element and the cooling element are disposed in the mold by drilling the mold. Therefore, for considering structural strength and manufacturing difficulty of the mold, the disposition places and shapes of the heating element and the cooling element may be limited. a heating effect or a heat dissipating effect of the mold may be also limited.

BRIEF SUMMARY OF THE INVENTION

One objective of this invention is to provide a method of manufacturing a mold for injection molding capable of being free from limiting a shape of a temperature control element and being easily processed and to provide a mold for injection molding capable of improving a heating effect or a heat dissipating effect.

The invention provides a method of manufacturing a mold for injection molding. The method includes the following steps. At least one temperature control element is provided. The temperature control element is covered in a first material. Further, the first material is mechanically processed to form a mold body with a cavity.

The invention provides a mold for injection molding including a mold body, a temperature control element, and a heat insulating layer. The mold body has a cavity, and the mold body is formed by mechanically processing a first material. The temperature control element is covered in the mold body. The heat insulating layer corresponds to the temperature control element and is formed on the mold body.

In one embodiment of the invention, the temperature control element may be covered with the first material by spray welding or casting.

In one embodiment of the invention, the method may further include the step of forming a heat insulating layer corresponding to the temperature control element on the mold body.

In one embodiment of the invention, the method may further include the step of forming a flat layer on the cavity.

In one embodiment of the invention, before the step of providing the temperature control element, the method may include the step of manufacturing the temperature control element to be a predetermined shape. The temperature control element may be platy, netlike, linear, S-shaped, U-shaped, or spiral.

According to the above, in the method of the embodiment, the temperature control element may be first manufactured to be a predetermined shape, such as a U-shape, a spiral shape and so on, and then the temperature control element can be covered with the first material by spray welding or casting. Thereby, the shape of the temperature control element of the mold for injection molding may be not limited, and the heating effect or the heat dissipating effect of the mold may be improved by the temperature control element with different shapes. In addition, the mold in the invention is easily processed, and the structural strength of the mold is remained.

These and other features, aspects, and advantages of the present invention will become better understood with regard to the following description, appended claims, and accompanying drawings.

DETAILED DESCRIPTION OF THE INVENTION

A mold for injection molding and a method of manufacturing thereof are described, and the same element is marked by the same reference number.

Figure 1:
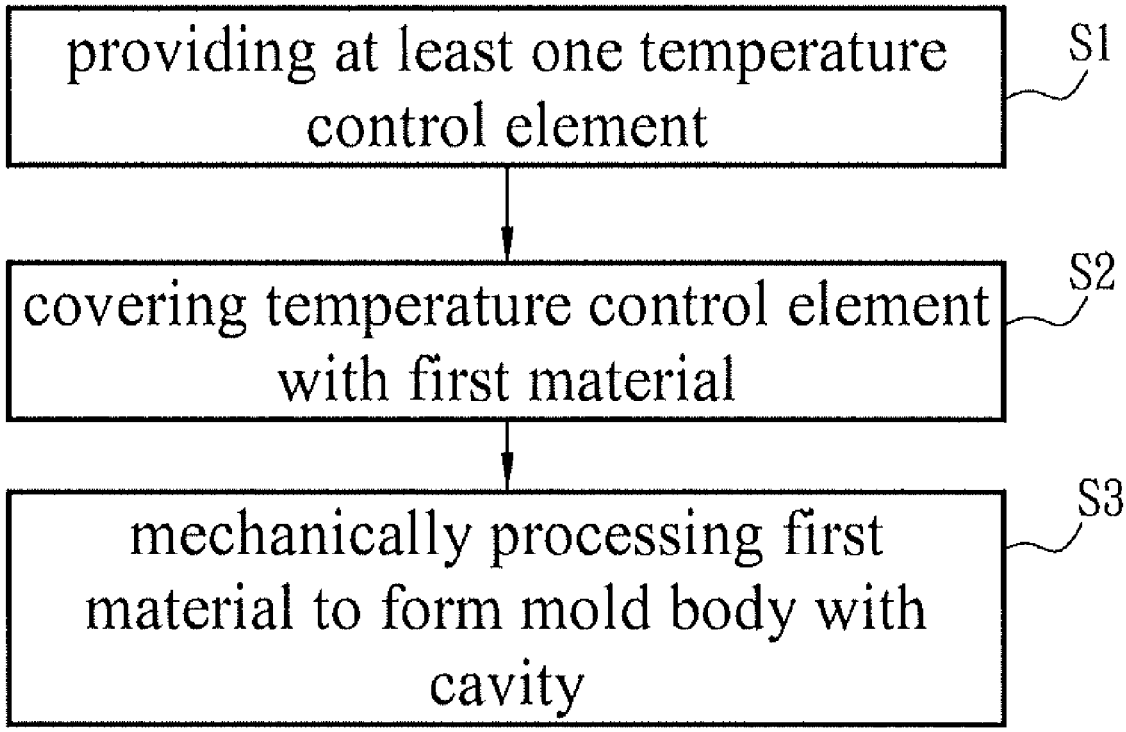
FIG. 1 is a flowchart showing a method of manufacturing a mold for injection molding according to one preferred embodiment of the invention.
Figure 2A:
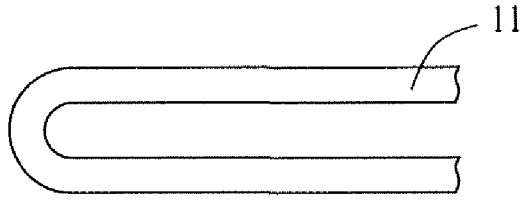
FIG. 2A to FIG. 2C are sectional schematic diagrams showing a method of manufacturing a mold for injection molding according to one preferred embodiment of the invention.
Figure 2B:
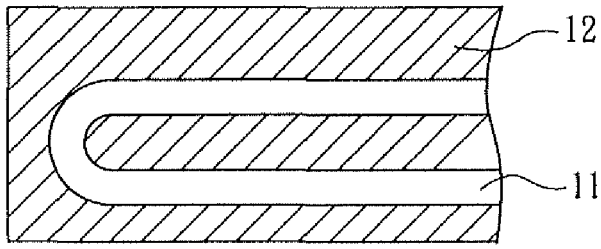
Figure 2C:
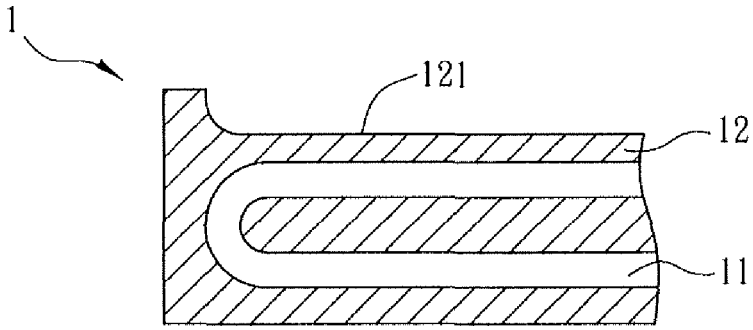

FIG. 1 is a flowchart showing a method of manufacturing a mold 1 for injection molding according to one preferred embodiment of the invention. FIG. 2A to FIG. 2C are sectional schematic diagrams showing the method of manufacturing the mold 1 for injection molding according to one preferred embodiment of the invention. The method of manufacturing the mold 1 for the injection molding includes step S1 to step S3.

In FIG. 1 and FIG. 2A, in step S1, at least one temperature control element 11 is provided. The temperature control element 11 may be a cool plate, a cool tube, a heat plate, a heat tube, or a combination thereof. In addition, before the step of providing the temperature control element 11, the temperature control element 11 may be manufactured to be a predetermined shape. The predetermined shape may be a platy shape, a netlike shape, a linear shape, an S-shape, a U-shape, a spiral shape, or other shapes. In other words, a platy cool plate or a play heat plate may be directly used as the temperature control element 11, or a cool plate or a heat plate may be bent to form an S-shaped or U-shaped section. Certainly, a linear tube, such as a copper tube, may be directly used as the temperature control element 11. The tube may be bent to form a netlike shape, an S-shape, a U-shape, a spiral shape, or other shapes. Further, a plurality of tubes may be bent to form a netlike shape, a spiral shape, or other shapes. In the embodiment, the temperature control element 11 is a U-shaped tube. However, the invention is not limited thereto. When cold water or cooling liquid is injected into the tube, the tube may be used as a cool tube. When hot water or heating liquid is injected into the tube, the tube may be used as a heat tube.

In FIG. 1 and FIG. 2B, in step S2, the temperature control element 11 is covered with a first material 12. The first material 12 may include copper, iron, aluminum, zinc, tin, nickel, an alloy thereof, or a combination thereof, and the first material 12 may be used to cover the temperature control element 11 by spray welding or casting. To improve a heating effect or a heat dissipating effect of the temperature control element 11, the first material 12 may be made of different metal. For example, the temperature control element 11 may be first covered with a molten aluminum alloy by spray welding by pressure air, and then the molten aluminum alloy may be covered with molten copper by spray welding. However, the invention is not limited thereto. The first material 12 may be formed by casting or may be made of a single material.

In FIG. 1 and FIG. 2C, in step S3, a mold body is formed by mechanically processing the first material 12, and the mold body has a cavity 121. The first material 12 may be processed by a mechanical process such as a cutting process, such as turn-milling and so on, or a pressure process, such as punching and so on, to form the mold body with the cavity 121. The shape of the cavity 121 corresponds to that of a product to be formed by injection molding. In addition, the mold 1 in the embodiment may be a male core or a female core. However, the invention is not limited thereto. Further, the male core and the female core may be manufactured by the method in the embodiment.

Therefore, in the method of manufacturing the mold 1 for injection molding in the embodiment, the temperature control element 11 may be first manufactured to be a predetermined shape, such as a netlike shape, an S-shape, a U-shape, a spiral shape and so on, and then the temperature control element 11 may be covered with the first material 12 by spray welding or casting. Thereby, the shape of the temperature control element 11 of the mold 1 in the embodiment is not limited, and the heating effect or the heat dissipating effect of the mold 1 may be improved by the temperature control element 11 with different shapes. In addition, the mold 1 in the embodiment is easily processed, and reduction of the structural strength of the mold 1 may be avoided.

Figure 3:
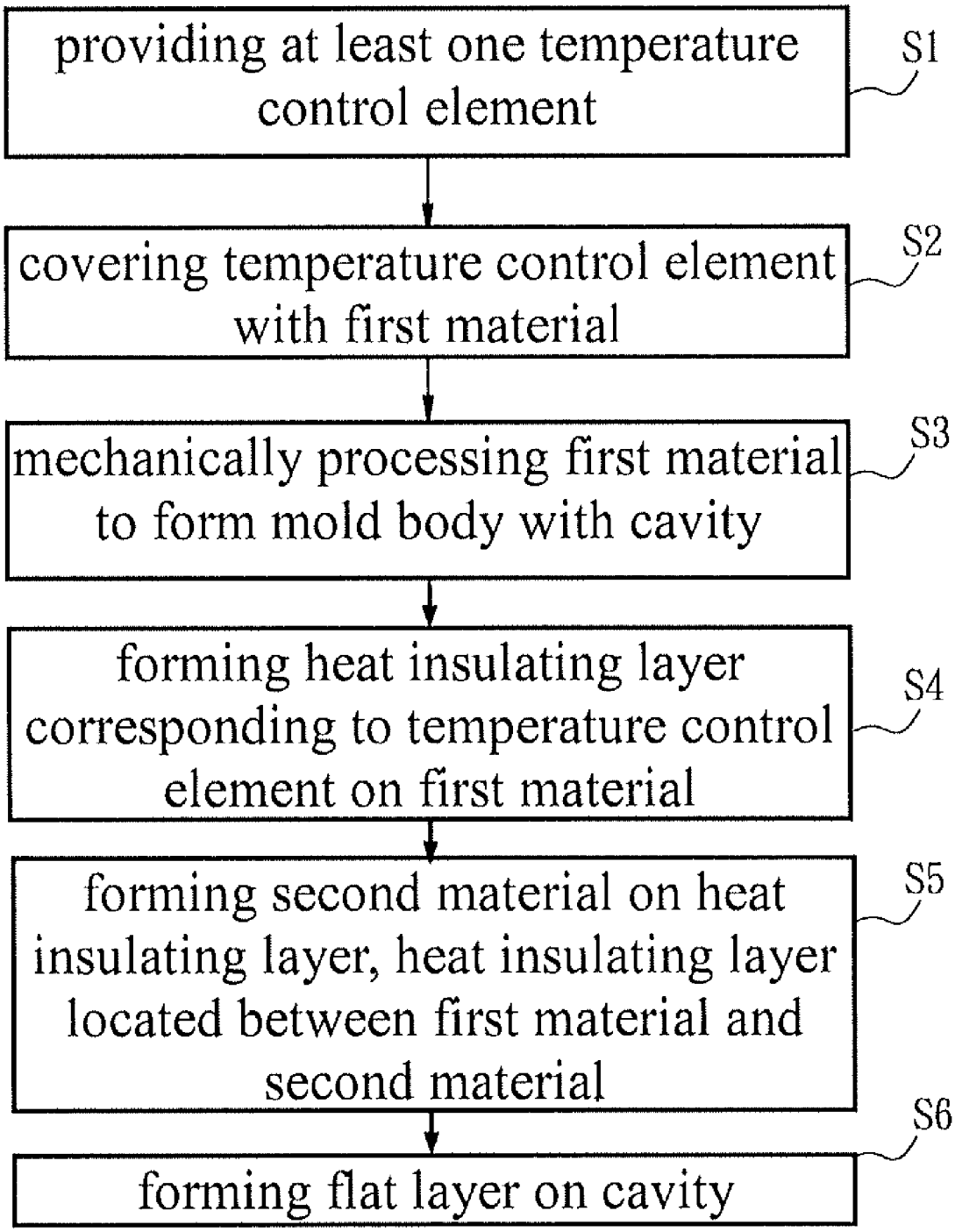
FIG. 3 is a flowchart showing a method of manufacturing a mold for injection molding in another form according to one preferred embodiment of the invention.
Figure 4A:
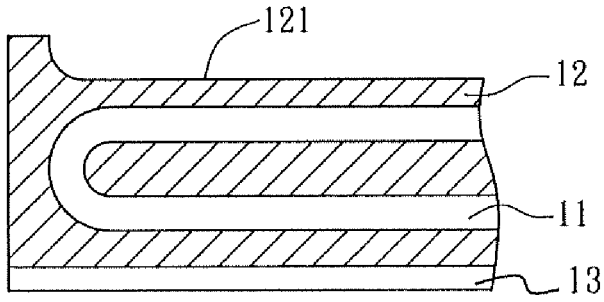
FIG. 4A to FIG. 4C are sectional schematic diagrams showing a method of manufacturing a mold for injection molding in another form according to one preferred embodiment of the invention.
Figure 4B:
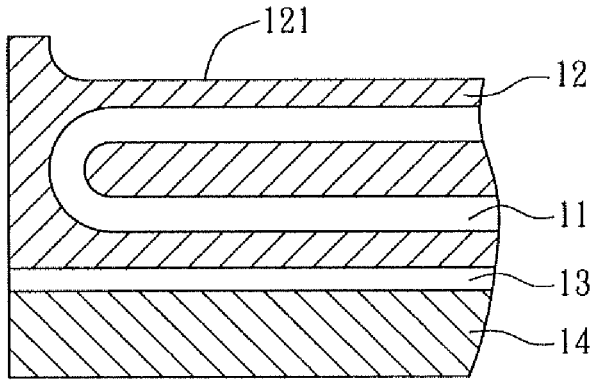
Figure 4C:
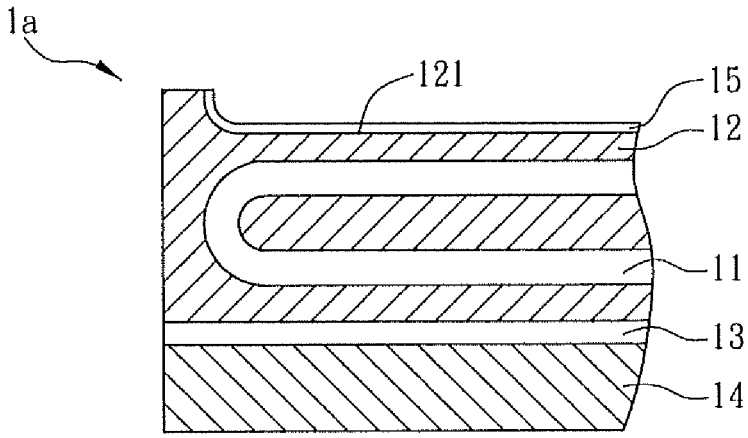

FIG. 3 is a flowchart showing a method of manufacturing a mold 1*a* for injection molding in another form according to one preferred embodiment of the invention. FIG. 4A to FIG. 4C are sectional schematic diagrams showing the method of manufacturing the mold 1*a* for injection molding in another form according to one preferred embodiment of the invention. Besides the manufacturing flow paths as shown in FIG. 1 and FIG. 2A to FIG. 2C, the method of manufacturing the mold 1*a* in this embodiment includes step S4 to step S6.

In FIG. 3 and FIG. 4A, in step S4, a heat insulting layer 13 corresponding to the temperature control element 11 is formed on the first material 12. The heat insulating layer 13 may be made of a material with a heat insulating effect such as ceramic and so on. When the temperature control element 11 is used for heating, a heating area may be limited to a special area to prevent heat from being dissipated and to improve the heating efficiency.

In FIG. 3 and FIG. 4B, in step S5, a second material 14 is formed on the heat insulating layer 13. The heat insulating layer 13 is located between the first material 12 and the second material 14. The material and manufacturing process of the second material 14 may be the same as or different from that of the first material 12. The second material 14 may include copper, iron, aluminum, zinc, tin, nickel, an alloy thereof, or a combination thereof, and the second material 14 may be formed by spray welding or casting. The same as the first material 12, the second material 14 may also be made of different metal. For example, the heat insulating layer 13 may be first covered with molten aluminum alloy by spray welding by pressure air, and then the aluminum alloy is covered with molten copper by spray welding. However, the invention is not limited thereto. The second material 14 may also be formed by casting or be made of a single material.

Further, the heat insulating layer 13 and the second material 14 may be first formed, and then the cavity 121 may be formed at the first material 12. Otherwise, after the heat insulating layer 13 is formed, the cavity 121 is formed on the first material 12, and then the second material 14 is formed on the heat insulating layer 13. In addition, the cavity 121 is formed at the first material 12, the cavity may also be formed at the second material 14 to satisfy different designs and needs.

In FIG. 3 and FIG. 4C, in step S6, a flat layer 15 is formed on the cavity 121. The flat layer 15 may be made of metal which is wear-resisting and is free from peeling off from the first material 12. The flat layer 15 may be formed on the cavity 121 by electroplating, electroforming, spray welding, or chemical deposition and so on, and then the flat layer 15 may be processed to form a flat surface by a finish machining process such as finish milling, grinding, polishing, or a combination thereof. Therefore, the surface of the cavity 121 may be flat by the flat layer 15 to prevent the spray welding or casting process of the first material 12 from generating holes at the cavity 121 and making the cavity 121 rough.

Figure 5:
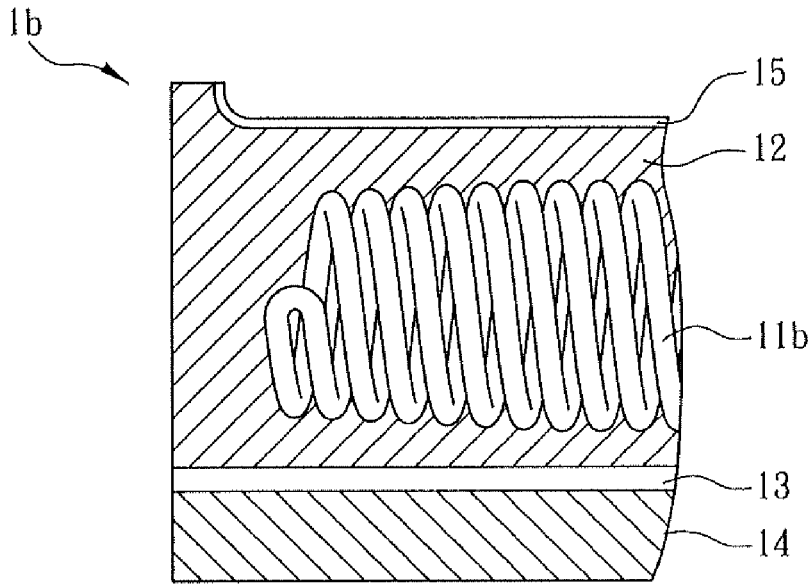
FIG. 5 and FIG. 6 are sectional schematic diagrams showing a mold for injection molding in different forms according to preferred embodiments of the invention.

FIG. 5 is a sectional schematic diagram showing a mold 1*b* of injection molding in another form according to one preferred embodiment. A temperature control element 11*b* of the mold 1*b* may be spiral, and the temperature control element 11*b* only has a heating , or cooling function by the temperature control element 11*b* may be a heat tube or a cool tube. Therefore, the needed temperature control element 11*b* may be correspondingly disposed to satisfy different needs.

Figure 6:
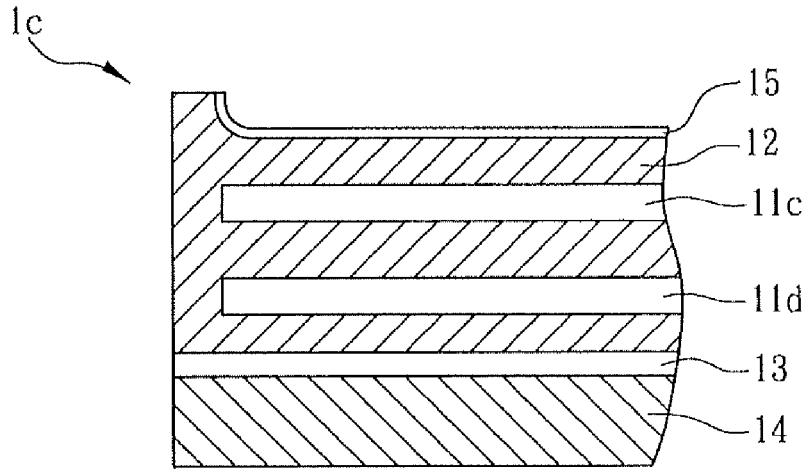

FIG. 6 is a sectional schematic diagram showing a mold 1*c* of injection molding in another form according to one preferred embodiment. The mold 1*c* includes temperature control elements 11*c*, 11*d*. The temperature control element 11*c* is used for heating, for example, the temperature control element 11*c* may be a heat tube. The temperature control element 11*d* is used for cooling, for example, the temperature control element 11*d* may be a cool tube. The shapes, disposition places, and relative positions of the temperature control elements are not limited. Thereby, the mold 1*c* may have different designs according to different needs.

To sum up, according to the method of manufacturing a mold for injection molding in the embodiments of the invention, the temperature control element may be first manufactured to be a predetermined shape, such as a U-shape, a spiral shape and so on, and then the temperature control element may be covered with the first material by spray welding or casting. Thereby, the shape of the temperature control element of the mold for injection molding is not limited, and the heating effect or the heat dissipating effect of the mold may be improved by the temperature control element with different shapes. In addition, the mold in the embodiment of the invention is easily processed, and reduction of the structural strength of the mold due to the temperature control element may be avoided.

In addition, the mold for injection molding in the embodiment of the invention includes a heat insulating layer and a flat layer. When the temperature control element is used for heating, the heating area may be limited to a special area by the heat insulating layer thus to prevent heat from being dissipated and to improve the heating efficiency. Further, the surface of the cavity may be flat by the flat layer to prevent the spray welding or casting process of the first material from generating holes at the cavity or making the cavity rough.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A method of manufacturing a mold for injection molding, comprising the following steps of:

providing at least one temperature control element;

covering the temperature control element with a first material;

mechanically processing the first material covering the temperature control element to produce a mold body with a cavity formed on the first material; and forming a heat insulating layer on the first material and forming a second material on the heat insulating layer, wherein the heat insulating layer is located between the first material and the second material.

2. The method according to claim 1, wherein the temperature control element is covered with the first material by spray welding or casting.

3. The method according to claim 1, wherein the first material includes copper, iron, aluminum, zinc, tin, nickel, an alloy thereof, or a combination thereof.

4. The method according to claim 1, further comprising the step of:

forming a flat layer on the cavity.

5. The method according to claim 4, wherein the flat layer is formed on the cavity by electroplating, electroforming, spray welding, or chemical deposition.

6. The method according to claim 4, further comprising the step of:

processing the flat layer by a finish machining process.

7. The method according to claim 6, wherein the finish machining process comprises finish milling, grinding, polishing, or a combination thereof.

8. The method according to claim 4, wherein the flat layer includes copper, iron, aluminum, zinc, tin, nickel, an alloy, or a combination thereof.

9. The method according to claim 1, wherein the temperature control element includes a cool plate, a cool tube, a heat plate, a heat tube, or a combination thereof.

10. The method according to claim 1, before the step of providing the temperature control element, the method further comprising the step of:

manufacturing the temperature control element to be a predetermined shape.

* * * * *